US008581919B2

(12) United States Patent
Park et al.

(10) Patent No.: US 8,581,919 B2
(45) Date of Patent: Nov. 12, 2013

(54) DISPLAY CONTROLLERS INCLUDING MEMORY CONTROLLERS

(75) Inventors: Yong-Yun Park, Seoul (KR); Won-Gab Jung, Gyeonggi-do (KR); Jong-Seon Kim, Gyeonggi-do (KR); Sang-Woo Kim, Seoul (KR); Hae-Yong Ahn, Seoul (KR)

(73) Assignee: Samsung Electronics Co., Ltd. (KR)

( * ) Notice: Subject to any disclaimer, the term of this patent is extended or adjusted under 35 U.S.C. 154(b) by 908 days.

(21) Appl. No.: 12/727,631

(22) Filed: Mar. 19, 2010

(65) Prior Publication Data

US 2010/0238186 A1 Sep. 23, 2010

(30) Foreign Application Priority Data

Mar. 20, 2009 (KR) ..... 10-2009-0024018

(51) Int. Cl.
*G09G 5/36* (2006.01)

(52) U.S. Cl.
USPC ..... 345/558; 345/531; 345/536; 345/537; 345/538

(58) Field of Classification Search
None
See application file for complete search history.

(56) References Cited

U.S. PATENT DOCUMENTS

| | | | | |
|---|---|---|---|---|
| 5,539,452 | A * | 7/1996 | Bush et al. | 348/14.13 |
| 5,802,581 | A | 9/1998 | Nelsen | |
| 5,937,204 | A * | 8/1999 | Schinnerer | 345/531 |
| 6,983,348 | B2 | 1/2006 | Jamil et al. | |
| 7,184,508 | B2 | 2/2007 | Emberling | |
| 2002/0178285 | A1 * | 11/2002 | Donaldson et al. | 709/237 |
| 2009/0135265 | A1 * | 5/2009 | Kawamura et al. | 348/220.1 |

FOREIGN PATENT DOCUMENTS

| | | |
|---|---|---|
| JP | 06-195258 | 7/1994 |

* cited by examiner

*Primary Examiner* — Jeffery A Brier
*Assistant Examiner* — Greg Raburn
(74) *Attorney, Agent, or Firm* — Myers Bigel Sibley & Sajovec

(57) ABSTRACT

A display controller is provided. The display controller includes an external memory and a timing controller which compresses current frame data to generate front first in-first out (FIFO) input data, temporarily stores the front FIFO input data and writes the front FIFO input data to the external memory in a burst mode, and reads data from the external memory in the burst mode, temporarily stores the read data as back FIFO output data, and decodes the back FIFO output data to output previous frame data.

9 Claims, 8 Drawing Sheets

FIG.6

| | BANK1 | BANK2 | BANK3 | BANK4 |
|---|---|---|---|---|
| 0 | 1A_1 | 1B_1 | 2A_1 | 2B_1 |
| | 3A_1 | 3B_1 | 4A_1 | 4B_1 |
| ⋮ | ⋮ | ⋮ | ⋮ | ⋮ |
| 539 | | | nA_1 | nB_1 |
| | | | | |
| 1024 | 1A_2 | 1B_2 | 2A_2 | 2B_2 |
| | 3A_2 | 3B_2 | 4A_2 | 4B_2 |
| ⋮ | ⋮ | ⋮ | ⋮ | ⋮ |
| 1563 | | | nA_2 | nB_2 |
| | | | | |

DISPLAY CONTROLLERS INCLUDING MEMORY CONTROLLERS

CLAIM OF PRIORITY

This application claims priority to Korean Patent Application No. 10-2009-0024018, filed Mar. 20, 2009, the contents of which are hereby incorporated herein by reference as if set forth in its entirety.

FIELD

This invention relates to display controllers and, more particularly, to display controllers including a memory controller capable of effectively writing or reading frame data to and/or from an external memory.

BACKGROUND OF THE INVENTION

Generally, a liquid crystal display (LCD) device has problems related to a response speed since liquid crystal which configures a pixel of an LCD panel has a low response speed. For example, when an LCD is used in television, which displays moving pictures, an afterimage remains. Display controllers that control the LCD devices include a response time accelerator (RTA), which processes image data before a source driver which drives the LCD panel in order to resolve the problems related to the response speed. The response time accelerator compares data of a previous frame stored in an external memory with data of a current frame and outputs an acceleration value for accelerating data of the current frame.

As the resolution of the LCD device has recently increased, the amount of data of one frame has also greatly increased. Therefore, the capacity of the external memory included in the display controller for an operation of the response time accelerator has to also increase, and the operation speed has to be faster, and thus a high cost external memory is required. In order to resolve this problem, in the case of storing frame data, frame data is compressed and written to the external memory, and in the case of outputting frame data, data stored in the external memory is read and decompressed.

SUMMARY

Some embodiments of the present invention provide a display controller including: an external memory; and a timing controller configure to compress current frame data to generate front first in-first out (FIFO) input data, temporarily store the front FIFO input data and write the front FIFO input data to the external memory in a burst mode, and reads data from the external memory in the burst mode, temporarily store the read data as back FIFO output data, and decode the back FIFO output data to output previous frame data.

In further embodiments, the timing controller may include: an encoder which compresses the current frame data to generate the front FIFO input data and outputs the front FIFO input data and an input valid signal representing a period in which the front FIFO input data is valid; a memory controller which temporarily stores the front FIFO input data and writes the front FIFO input data to the external memory in the burst mode in response to the input valid signal, and reads data from the external memory in the burst mode, temporarily stores the read data as the back FIFO output data and outputs the back FIFO output data in response to an output valid signal; and a decoder which outputs the output valid signal when decoding is ready, and receives and decodes the back FIFO output data to generate the previous frame data. The display controller may further include an acceleration value computer which receives the current frame data and the previous frame data and compares the current frame data with the previous frame data to output an acceleration value.

In still further embodiments, the memory controller may include: a controller which outputs a front control signal, a back control signal, a memory control signal, and a data buffer control signal, in response to the input valid signal and the output valid signal; a front FIFO which temporarily stores the front FIFO input data and outputs the stored data as the front FIFO output data, in response to the front control signal; a back FIFO which temporarily stores the back FIFO input data and outputs the stored data as the back FIFO output data in response to the back control signal; and a data buffer which outputs the front FIFO output data to the external memory or outputs data output from the external memory as the back FIFO input data, in response to the data buffer control signal. The external memory may write data input from the data buffer in the burst mode or read stored data in the burst mode and output the data to the data buffer, in response to the memory control signal.

In some embodiments, the front FIFO may include: first and second front memories which store and output data in response to the front control signal; a front input switch which outputs the front FIFO input data to the first front memory or the second front memory, in response to the front control signal; and a front output switch which outputs data output from the first front memory or the second front memory as the front FIFO output data, in response to the front control signal.

In further embodiments, the back FIFO may include: first and second back memories which store and output data in response to the back control signal; a back input switch which outputs the back FIFO input data to the first back memory or the second back memory, in response to the back control signal; and a back output switch which outputs data output from the first back memory or the second back memory as the back FIFO output data, in response to the back control signal.

In still further embodiments, the first and second front memories and the first and second back memories may be dual port memories.

In some embodiments, when frame data of a first frame is input, the controller in a first input period, may output the front control signal in response to the input valid signal so that the front FIFO input data is stored in the first front memory; in a second input period, may output the front control signal so that data stored in the first front memory is output as the front FIFO output data and the front FIFO input data is stored in the second front memory in response to the input valid signal, and output the memory control signal and the data buffer control signal so that the front FIFO output data is written to the external memory in the burst mode; in a third input period, may output the front control signal so that data stored in the second front memory is output as the front FIFO output data and the front FIFO input data is stored in the first front memory in response to the input valid signal, and output the memory control signal and the data buffer control signal so that the front FIFO output data is written to the external memory in the burst mode; and may repeat the operations of the second input period and the third input period until all data of the first frame are stored, and when all data of the first frame are stored, output the memory control signal, the data buffer control signal, and the back control signal to read data of a first line among data of the first frame from the external memory in the burst mode and temporarily store the data of the first line in the first back memory and the second back memory.

In further embodiments, when data of a second or subsequent frame is input, the controller in a first input/output period, may output the front control signal so that the front FIFO input data is stored in the first front memory and output the back control signal so that data stored in the first back memory is output as the back FIFO output data; in a second input/output period, may output the front control signal so that the front FIFO input data is stored in the second front memory and data stored in the first front memory is output as the front FIFO output data, output the memory control signal and the data buffer control signal so that the front FIFO output data is written to the external memory in the burst mode and frame data corresponding to ½ of a second line among data of a previous frame stored in the external memory is read in the burst mode and output as the back FIFO input data, and output the back control signal so that data stored in the second back memory is output as the back FIFO output data and the back FIFO input data is stored in the first back memory; in a third input/output period, may output the front control signal so that the front FIFO input data is stored in the first front memory and data stored in the second front memory is output as the front FIFO output data, output the memory control signal and the data buffer control signal so that the front FIFO output data is written to the external memory in the burst mode and frame data corresponding to the remaining ½ of the second line among the data of the previous frame stored in the external memory is read in the burst mode to be output as the back FIFO input data, and output the back control signal so that data stored in the first back memory is output as the back FIFO output data and the back FIFO input data is stored in the second back memory; and may repetitively perform the operations of the second input/output period and the third input/output period for data of each remaining line among frame data.

In still further embodiments, the controller may include: a front FIFO controller which outputs the front control signal in response to the input valid signal and a write execution signal, outputs a write ready signal when a predetermined amount of data is written to the first front memory or the second front memory, and outputs a first frame end signal when all data of the first frame are input/output in/from the front FIFO; a back FIFO controller which outputs the back control signal in response to the first frame end signal, the output valid signal, and a read execution signal and outputs a read ready signal when all data stored in the first back memory or the second back memory are output; and a main controller which outputs the memory control signal, the data buffer control signal and the write execution signal in response to the write ready signal so that the front FIFO output data is written to the external memory in the burst mode, and outputs the memory control signal, the data buffer control signal and the read execution signal in response to the read ready signal so that data stored in the external memory is read in the burst mode and output to the back FIFO.

In some embodiments, the external memory may include $n^{th}$ to $(n+3)^{th}$ banks, and the controller may output the memory control signal so that data output from the first front memory is sequentially stored in the $n^{th}$ bank and $(n+2)^{th}$ bank and data output from the second front memory is sequentially stored in the $(n+1)^{th}$ bank and $(n+3)^{th}$ bank.

BRIEF DESCRIPTION OF THE DRAWINGS

Example embodiments are described in further detail below with reference to the accompanying drawings. It should be understood that various aspects of the drawings may have been exaggerated for clarity.

FIG. 6 illustrates a memory mapping example of an external memory of the response time accelerator illustrated in FIG. 1.

DETAILED DESCRIPTION OF THE EMBODIMENTS

Figure 1:
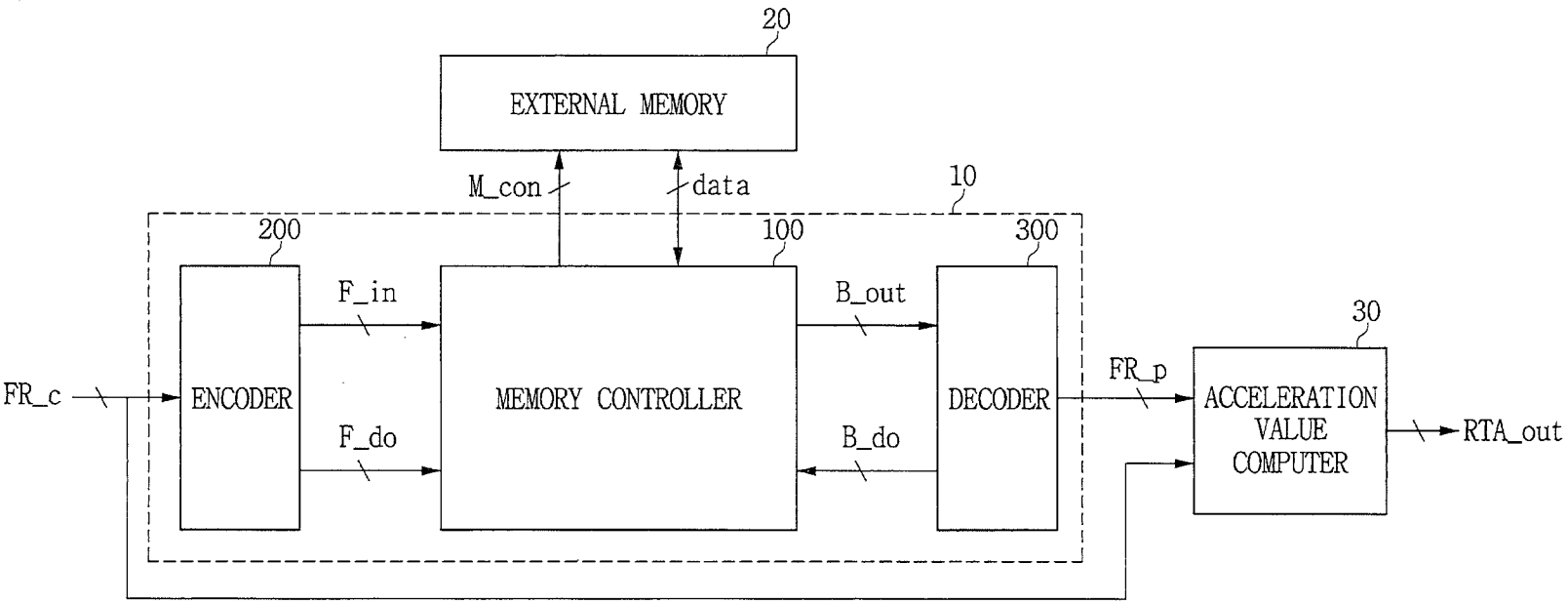
FIG. 1 is a block diagram of a response time accelerator according to some embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the Figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In order to more specifically describe example embodiments, various aspects will be described in detail with reference to the attached drawings. However, the inventive concept is not limited to example embodiments described.

Referring first to FIG. 1, a block diagram of a display controller according to some embodiments will be discussed. As illustrated in FIG. 1, the display controller may be configured to include a timing controller 10, an external memory 20, and an acceleration value computer 30. The timing controller 10 may be configured to include a memory controller 100, an encoder 200, and a decoder 300.

Functions of the respective blocks illustrated in FIG. 1 will now be discussed. The timing controller 10 compresses current frame data FR_c to generate front first in-first out (FIFO) input data Fin, temporarily store the front FIFO input data Fin, and then write the front FIFO input data F_in to the external memory 20 in a burst mode. The timing controller 10 reads data from the external memory 20 in the burst mode, temporarily stores the read data as back FIFO output data B_out, and then decodes the back FIFO output data B_out to output previous frame data FR_p.

The encoder 200 compresses the current frame data FR_c input from the outside to output the front FIFO input data F_in, and outputs an input valid signal F_do representing a valid period of the front FIFO input data F_in.

The memory controller 100 temporarily stores the front FIFO input data F_in response to the input valid signal F_do and writes the temporarily stored front FIFO input data F_in to the external memory 20 in the burst mode. The memory controller 100 reads data stored in the external memory 20 and temporarily stores the read data in the burst mode and outputs the temporarily stored data as the back FIFO output data B_out in response to an output valid signal B_do.

The decoder 300 outputs the output valid signal B_do, which represents that it is ready to decode, to the memory controller 100 and decodes the back FIFO output data B_out output from the memory controller 100 to generate the previous frame data FR_p.

The external memory 20 writes/reads data in the burst mode in response to a control signal M_con output from the memory controller 100. The external memory 20 may be configured by a synchronous dynamic random access memory (SDRAM).

The acceleration value computer 30 compares the previous frame data FR_p output from the decoder 300 of the timing controller 10 with the current frame data FR_c input from the outside and outputs an acceleration value RTA_out according to a difference therebetween.

That is, the memory controller 100 of the display controller according to some embodiments temporarily stores input frame data and writes the temporarily stored frame data to the external memory 20 in the burst mode. The memory controller 100 reads frame data from the external memory 20 in the burst mode, temporarily stores the frame data and outputs the frame data to the outside in response to a signal (i.e., the output valid signal B_do) input from the outside. Therefore, since data is written/read to/from the external memory 20 in the burst mode, a write/read operation for overall data can be rapidly performed. Consequently, even though the operation speed of the external memory is not fast, a large amount of data can be rapidly written or read.

Figure 2:
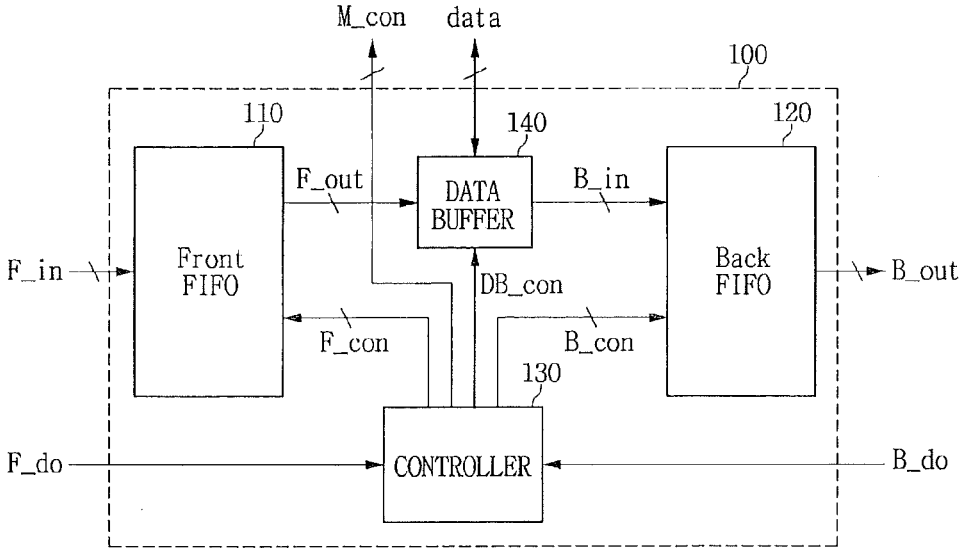
FIG. 2 is a block diagram of a memory controller of the response time accelerator illustrated in FIG. 1.

Referring now to FIG. 2, a block diagram of the memory controller 100 of the display controller illustrated in FIG. 1 will be discussed. As illustrated in FIG. 2, the memory controller 100 may be configured to include a front FIFO 110, a back FIFO 120, a controller 130, and a data buffer 140.

Functions of the respective blocks illustrated in FIG. 2 will now be discussed. The front FIFO 110 receives and temporarily stores the front FIFO input data Fin output from the encoder 200 in response to a front control signal F_con output from the controller 130, and outputs the stored data to the data buffer 140 as the front FIFO output data F_out in response to the front control signal F_con.

The back FIFO 120 receives and temporarily stores the back FIFO input data B_in output from the data buffer 140 in response to a back control signal B_con output from the controller 130, and outputs the stored data as the back FIFO output data B_out in response to the back control signal B_con.

The controller 130 outputs the front control signal F_con for controlling the front FIFO 110 in response to the input valid signal F_do output from the encoder 200, outputs the back control signal B_con for controlling the back FIFO 120 in response to the output valid signal B_do output from the decoder 300, and outputs the memory control signal M_con for controlling the external memory 20 and a data buffer control signal DB_con for controlling the data buffer 140 in order to write/read data to/from the external memory 20 in the burst memory at appropriate time.

For example, the controller 130 outputs the front control signal F_con in response to the input valid signal F_do output from the encoder 200 so that the front FIFO 110 can receive and store the front FIFO input data F_in. Next, when a predetermined amount of data is stored in the front FIFO 140, the controller 130 outputs the front control signal F_con so that the front FIFO 110 can output the stored data to the data buffer 140. The controller 130 outputs the data buffer control signals DB_con so that the data buffer 140 can output input data F_out to the external memory 20, and outputs the memory control signal M_con so that the external memory 20 can write data output from the data buffer 140 in the burst mode.

The controller 130 outputs the back control signal B_con in response to the output valid signal B_do output from the decoder 300 so that the back FIFO 120 can output stored data. Next, when a predetermined amount of data is output from the back FIFO 120, the controller 130 outputs the memory control signal M_con so that the external memory 20 can perform the read operation in the burst mode, and outputs the data buffer control signal DB_con so that the data buffer 140 can output data input from the external memory 20 to the back FIFO 120.

Figure 3:
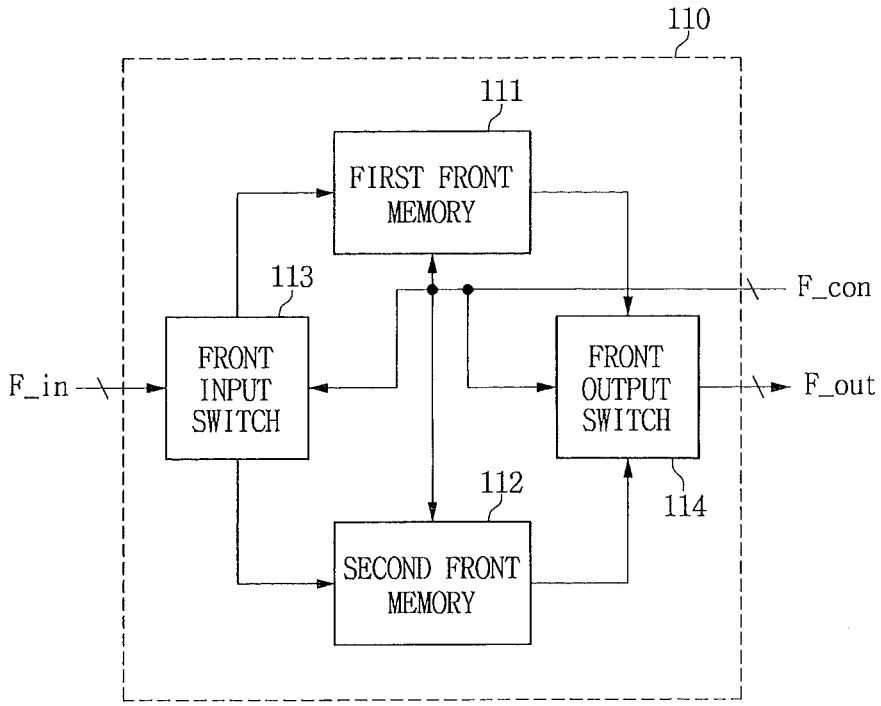
FIG. 3 is a block diagram of a front first in first out (FIFO) of the memory controller of the response time accelerator illustrated in FIG. 2.

Referring now to FIG. 3, a block diagram of the front FIFO 110 of the memory controller 100 of the display controller illustrated in FIG. 2 will be discussed. As illustrated in FIG. 3, the front FIFO 110 may be configured to include a first front memory 111, a second front memory 112, a front input switch 113, and a front output switch 114.

Functions of the respective blocks illustrated in FIG. 3 will be described below.

The first front memory 111 and the second front memory 112 perform the read/write operation in response to the front control signal F_con output from the controller 130. The first front memory 111 and the second front memory 112 may be configured by SDRAMs with fast operation speeds. Alternatively, the first front memory 111 and the second front memory 112 may be configured by dual port memory devices. In this case, a port used in the case of performing the write operation may be different from a port used in the case of performing the read operation.

The front input switch 113 applies the front FIFO input data F_in output from the encoder 200 to the first front memory 111 or the second front memory 112 in response to the front control signal F_con output from the controller 130. The front output switch 114 outputs data output from the first front memory 111 or the second front memory 112 as the front FIFO output data F_out in response to the front control signal F_con output from the controller 130.

Figure 4:
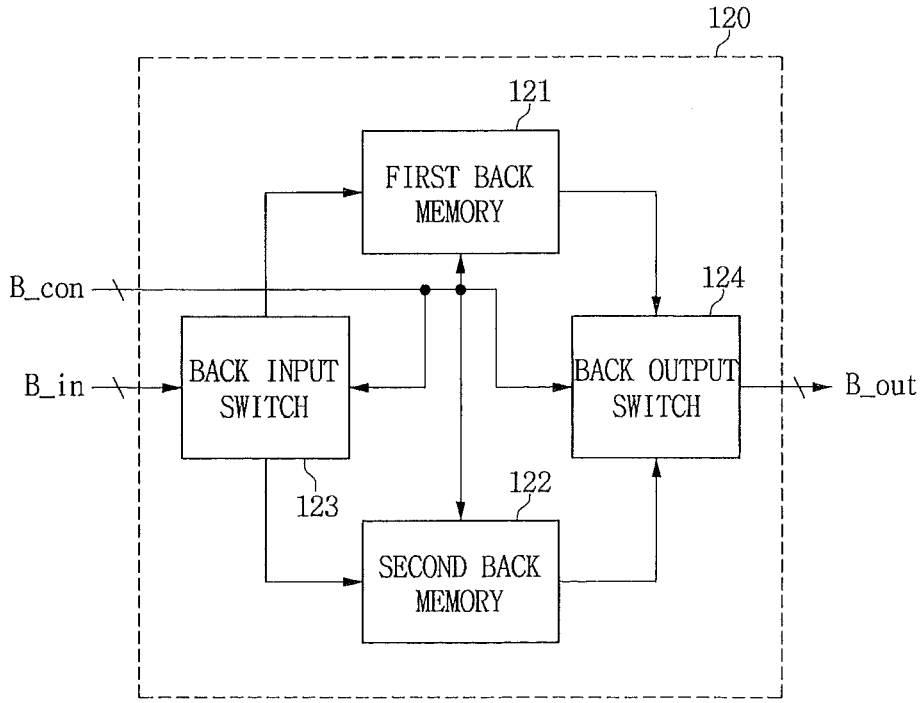
FIG. 4 is a block diagram of a back FIFO of the memory controller of the response time accelerator illustrated in FIG. 2.

Referring now to FIG. 4, a block diagram of the back FIFO 120 of the memory controller 100 of the display controller illustrated in FIG. 2 will be discussed. As illustrated in FIG. 4, the back FIFO 120 may be configured to include a first back memory 121, a second back memory 122, a back input switch 123, and a back output switch 124.

Functions of the respective blocks illustrated in FIG. 4 will now be discussed. The first back memory 121 and the second back memory 122 perform the write/read operation in response to the back control signal B_con output from the controller 130. The first back memory 121 and the second back memory 122 may be configured by SDRAMs with fast operation speeds. Alternatively, the first back memory 121 and the second back memory 122 may be configured by dual port memory devices. In this case, a port used in the case of performing the write operation may be different from a port used in the case of performing the read operation.

The back input switch 123 applies the back FIFO input data F_in output from the external memory 20 through the data buffer 140 to the back memory 121 or the second back memory 122 in response to the back control signal B_con output from the controller 130. The back output switch 124 outputs data output from the first back memory 121 or the second back memory 122 as the back FIFO output data B_out in response to the back control signal B_con output from the controller 130.

Figure 5:
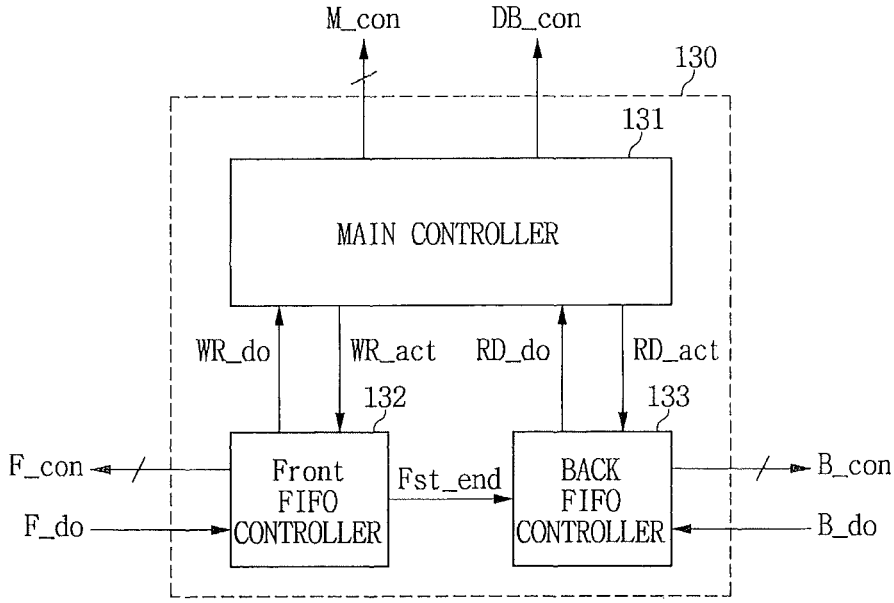
FIG. 5 is a block diagram of a controller of the memory controller of the response time accelerator illustrated in FIG. 2.

Referring now to FIG. 5, a block diagram of the controller 130 of the memory controller 100 of the display controller illustrated in FIG. 2 will be discussed. As illustrated in FIG. 5, the controller 130 may be configured to include a main controller 131, a front FIFO controller 132, and a back FIFO controller 133.

Functions of the respective blocks illustrated in FIG. 5 will now be discussed. The main controller 131 outputs the memory control signal M_con for controlling the external memory 20 and the data buffer control signal DB_con for controlling the data buffer 140. The main controller 131 outputs a write execution signal WR_act to the front FIFO controller 132 in response to a write ready signal WR_do output from the front FIFO controller 132. The main controller 131 outputs a read execution signal RD_act to the back FIFO controller 133 in response to a read ready signal RD_do output from the back FIFO controller 133. That is, the main controller 131 performs a function of controlling overall operation timing of the front FIFO 110, the back FIFO 120, and the external memory 20.

The front FIFO controller 132 outputs the front control signal F_con in response to the input valid signal F_do output from the encoder 200 so that the first front memory 111 and the second front memory 112 of the front FIFO 110 can receive and store the front FIFO input data F_in sequentially output from the encoder 200, and output the write ready signal WR_do to the main controller 131 when a predetermined amount of front FIFO input data F_in is stored in one of the first front memory 111 and the second front memory 112. The front FIFO controller 132 outputs the front control signal F_con in response to the write ready signal WR_act output from the main controller 131 so that the first front memory 111 and the second front memory 112 of the front FIFO 110 can output sequentially stored data as the front FIFO output data F_out. The front FIFO controller 132 outputs a first frame end signal Fst_end after the front FIFO 110 stores and then outputs overall data for one frame.

The back FIFO controller 133 outputs the read ready signal RD_do to the main controller 131 when the first frame end signal Fst_end output from the front FIFO controller 132 is received. The back FIFO controller 133 outputs the back control signal con B_con in response to the output valid signal B_do output from the decoder 300 so that the first back memory 121 and the second back memory 122 of the back FIFO 120 can output sequentially stored data as the back FIFO output data B_out, and outputs the read ready signal RD_do to the main controller 131 when all data stored in the first back memory 121 or the second back memory 122 of the back FIFO 120 are output. The back FIFO controller 133 outputs the back control signal B_con in response to the read execution signal RD_act output from the main controller 131 so that the first back memory 121 and the second back memory 122 of the back FIFO 120 can sequentially store the back FIFO input data Bin output from the data buffer 140.

Referring now to FIG. 6, a memory mapping example of the external memory 200 of the display controller illustrated in FIG. 1 according to some embodiments will be discussed. As illustrated in FIG. 6, the external memory 200 may be configured to include four banks BANK1 to BANK4.

As further illustrated in FIG. 6, 1A_1 and 1A_2 denote areas in which data of frame data correspond to about ½ of a first line, 1B_1 and 1B_2 denote areas in which data of frame data correspond to the remaining ½ of the first line, 2A_1 and 2A_2 denote areas in which data of frame data correspond to about ½ of a second line, and 2B_1 and 2B_2 denote areas in which data of frame data correspond to the remaining ½ of the second line. 1A_1, 1B_1, 2A_1, 2B_1, . . . denote areas in which frame data of odd-numbered frames are stored, and 1A_2, 1B_2, 2A_2, 2B_2, . . . denote areas in which frame data of even-numbered frames are stored.

As further illustrated in FIG. 6, areas in which frame data of even-numbered frames are stored start from an area in which a row address is 1024, but the row address may be changed.

Figure 7:
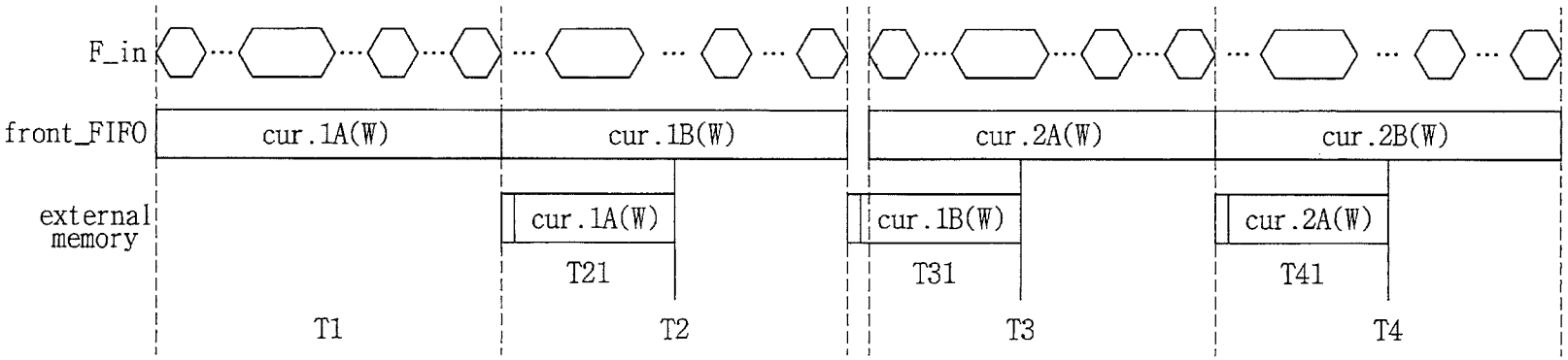
FIG. 7 is an operational timing diagram illustrating operations of the memory controller of the response time accelerator according to some embodiments when data of a first frame is input.
Figure 8:
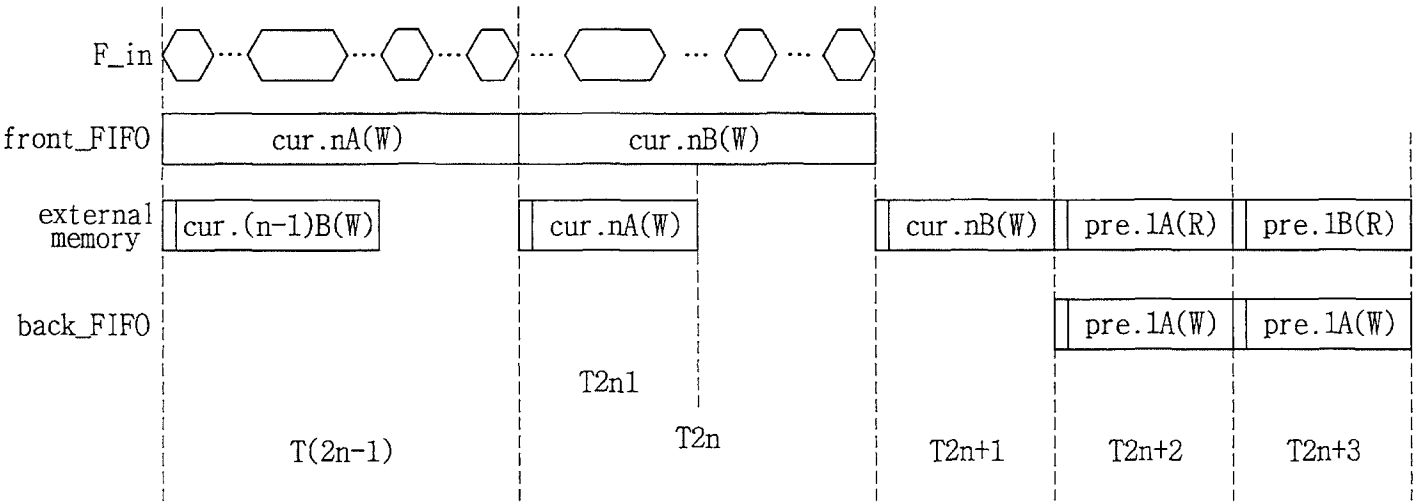
FIG. 8 is an operational timing diagram illustrating operations of the memory controller of the response time accelerator according to some embodiments when data storage of the first frame is finished.
Figure 9:
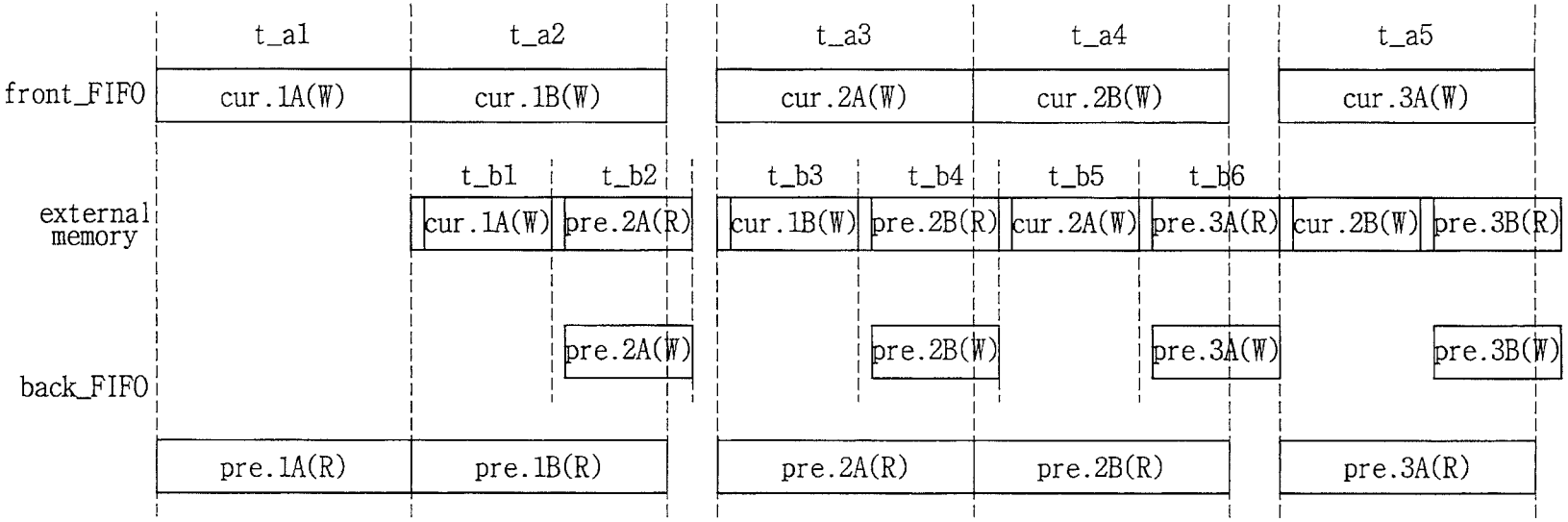
FIG. 9 is an operational timing diagram illustrating operations of the memory controller of the response time accelerator according to some embodiments when data of a second or subsequent frame is input.

FIGS. 7 to 9 are operational timing diagrams illustrating operations of the memory controller 100 of the display controller according to some embodiments. FIG. 7 is an operational timing diagram illustrating operations of a period in which storage of frame data of a first frame begins. FIG. 8 is an operational timing diagram illustrating operations of a period in which storage of frame data of the first frame is finished. FIG. 9 is an operational timing diagram illustrating operations when frame data of a second or subsequent frame is input. In FIGS. 7 to 9, F_in denotes front FIFO input data output from the encoder 200, which is compressed frame data, and Front_FIFO, External Memory, and Back_FIFO denote timing diagrams for explaining operations of the front FIFO, the external memory, and the back FIFO, respectively.

Operation of the memory controller 100 of the display controller according to some embodiments will be described below with reference to FIGS. 7 to 9. Referring first to FIG. 7, an operation of storing frame data of the first frame will be now be discussed. First, an operation of a period T1 is as follows. The front FIFO controller 132 of the controller 130 outputs the front control signal F_con to the front input switch 113 so that the front input switch 113 of the front FIFO 110 can apply the input front FIFO input data F_in to the first front memory 111 and outputs the front control signal F_con to the first front memory 111 so that the first front memory 111 can store the input front FIFO input data F_in.

Next, an operation of a period T2 is as follows. When a predetermined amount of data is stored in the first front memory 111, the front FIFO controller 132 outputs the write ready signal WR_do to the main controller 131. In response to the write ready signal WR_do, the main controller 131 outputs the data buffer control signal DB_con so that the data buffer 140 can receive the front FIFO output data F_out output from the front FIFO 110 and output the data to the external memory 20, outputs the memory control signal M_con so that the external memory 20 can store the data input in the burst mode, and outputs the read execution signal WR_act to the front FIFO controller 132. The main controller 131 may be configured to output the memory control signal M_con so that the external memory 20 can store data in the area 1A_1 of the external memory illustrated in FIG. 6. In response to the read execution signal WR_act, the front FIFO controller 132 outputs the front control signal F_con to the first front memory 111 so that the first front memory 111 of the front FIFO 110 can output stored data, and outputs the front control signal F_con to the front output switch 114 so that the front output switch 114 can output data output from the first front memory 111 as the front FIFO output data F_out. That is, in the period T2, data stored in the first front memory 111 in the period T1 is written to the external memory 20 in the burst mode.

In the period T2, the front FIFO controller 132 outputs the front control signal F_con to the front input switch 113 so that the front input switch 113 can output the input front FIFO input data F_in to the second front memory 112, and outputs the front control signal F_con to the second front memory 112 so that the second front memory 112 can store input data.

Subsequently, an operation of a period T3 is as follows. The front FIFO controller 132 outputs the write ready signal WR_do to the main controller 131 when a predetermined amount of data is stored in the second front memory 112. The main controller 131 controls the data buffer 140 to output the front FIFO output data F_out to the external memory 20 and outputs the memory control signal M_con so that the external memory 20 can write input data. The main controller 131 may be configured to output the memory control signal M_con so that the external memory 20 can store input data in the area 1B_1 illustrated in FIG. 6. The main controller 131 outputs the write execution signal WR_act to the front FIFO controller 132. In response to the write execution signal WR_act, the front FIFO controller 132 outputs the front control signal F_con so that the front output switch 114 can output data output from the second front memory 112 as the front FIFO output data F_out and outputs the front control signal F_con so that the second front memory 112 can output stored data. That is, in the period T3, data stored in the second front memory 112 is stored in the external memory 20 in the burst mode.

The front FIFO controller 132 outputs the front control signal F_con to the front input switch 113 so that the front input switch 113 can apply the front FIFO input data F_in to the first front memory 111 and outputs the front control signal F_con to the first front memory 111 so that the first front memory 111 can store input data.

An operation of a period T4 is similar to the operation of the period T2. However, the main controller 131 may be configured to output the memory control signal M_con so that the external memory 20 can store input data in the area 2A_1 illustrated in FIG. 6.

That is, the front FIFO input data F_in, which is compressed frame data output from the encoder 200, is not regularly input as illustrated in FIG. 7. Therefore, the memory controller 100 of the response time accelerator according to some embodiments temporarily stores input data in the front FIFO 110 and then stores the stored data in the external memory 20 in the burst mode.

Referring now to FIG. 8, an operation of a period in which an operation of storing data of the first frame is finished will now be discussed. An operation of a period T(2*n*−1) can be easily understood with reference to the description on the period T3 of FIG. 7. An operation of a period T2*n* can be easily understood with reference to the description on the period T2 of FIG. 7. In the period T2*n*+1, in response to the write execution signal WR_act, the front FIFO controller 132 outputs the front control signal F_con to the second front memory 112 so that the second front memory 112 can output stored data and outputs the front control signal F_con to the front output switch 114 so that the front output switch 114 can output data output from the second front memory 112 as the front FIFO output data F_out. The main controller 131 outputs the data buffer control signal DB_con so that the data buffer 140 can output the front FIFO output data F_out to the external memory 20 and outputs the memory control signal M_con so that the external memory 20 can write input data in the burst mode. The front FIFO controller 132 outputs the first frame end signal Fst_end representing that all frame data of the first frame is input.

In a period T2*n*+2, the back FIFO controller 133 outputs the read ready signal RD_do to the main controller 131 in response to the first frame end signal Fst_end. The main controller 131 outputs the memory control signal M_con to the external memory 20 so that the external memory 20 can perform the read operation in the burst mode when the read ready signal RD_do is input and the external memory 20 does not perform the write operation, and outputs the data buffer control signal DB_con so that the data buffer 140 can output data input from the external memory 20 as the back FIFO input data B_in. The main controller 131 may be configured to output the memory control signal M_con to the external memory 20 so that data in the area 1A_1 of FIG. 6 can be read. The main controller 131 outputs the read execution signal RD_act to the back FIFO controller 133. The back FIFO controller 133 outputs the back control signal B_con so that the first back memory 121 can store the back FIFO input data B_in input from the data buffer 140 when the read execution signal RD_act is input from the main controller 131. The back FIFO controller 133 outputs the back control signal B_con to the back input switch 123 so that the back input switch 123 can apply the back FIFO input data B_in to the first back memory 121, and outputs the back control signal B_con to the first back memory 121 so that the first back memory 121 can store input data.

In a period T2*n*+3, the back FIFO controller 133 outputs the read ready signal RD_do to the main controller 131 when the first back memory 121 stores a predetermined amount of data. The main controller 131 outputs the memory control signal M_con to the external memory 20 so that the external memory 20 can perform the read operation when the read ready signal RD_do is input from the back FIFO controller 133, and outputs the data buffer control signal DB_con so that the data buffer 140 can output data input from the external memory 20 as the back FIFO input data B_in. The main controller 131 may be configured to output the memory control signal M_con so that the external memory 20 can perform the read operation for the area 1B_1 of FIG. 6. The main controller 131 outputs the read execution signal RD_act to the back FIFO controller 133. The back FIFO controller 133 outputs the back control signal B_con to the back input switch 123 so that the back input switch 123 can apply the input back FIFO input data Bin to the back memory 122 when the read execution signal RD_act is input, and outputs the back control signal B_con to the second back memory 122 so that the second back memory 122 can store input data.

That is, after the operation of storing the data of the first frame is performed, frame data of the first frame is stored in the areas 1A_1, 1B_1, 2A_1, 2B_1, nA_1, and nB_1 of the external memory 20, and frame data of the first line among data of the first frame is stored in the back FIFO 120. The external memory 20 operates in the burst mode at the time of the write/read operation.

Referring now to FIG. 9, the write/read operation for the second or subsequent frame will now be discussed. In a period t_a1, the front FIFO controller 132 of the controller 130 controls the front FIFO 110 in response to the input valid signal F_do input from the encoder 200 so that the input front FIFO input data Fin can be stored in the first front memory 111. The back FIFO controller 133 outputs data stored in the first back memory 121 of the back FIFO 120 as the back FIFO output data B_out in response to the output valid signal B_do output from the decoder 300. The back FIFO output data B_out is input to the decoder 300, decoded and input to the acceleration value computer 500 as the previous frame data FR_p. Detailed operations of the front FIFO controller 132 and the back FIFO controller 133 can be easily understood with reference to FIGS. 7 and 8. The front back FIFO controller 132 outputs the write ready signal WR_do to the main controller 131 when a predetermined amount of data is stored in the first front memory 111, and the back FIFO controller 133 outputs the read ready signal RD_do to the main controller 131 after all data stored in the first back memory 121 are output.

In a period t_b1, the main controller 131 outputs the write execution signal WR_act to the front FIFO controller 132 in response to the write read signal WR_do output from the front FIFO controller 132. The front FIFO controller 132 controls the front FIFO 110 in response to the write execution signal WR_act so that data stored in the first front memory 111 can be output as the front FIFO output data F_out. The main controller 131 controls the external memory 20 and the data buffer 140 so that the front FIFO output data F_out can be written to the external memory 20 in the burst mode. The main controller 131 may control the external memory 20 so that the external memory 20 can write the data to the area 1A_2 of the external memory 20 illustrated in FIG. 6.

In a period t_b2, the main controller 131 controls the external memory 20 and the data buffer 140 in response to the read ready signal RD_do output from the back FIFO controller 133 so that data stored in the external memory 20 can be output to the back FIFO 120. The main controller 131 may control the external memory 20 so that the external memory 20 can perform the read operation for the area 2A_1 of the external memory 20 illustrated in FIG. 6. The main controller 131 controls the data buffer 140 so that the data buffer 140 can output data output from the external memory 20 as the back FIFO input data B_in. The main controller 131 outputs the read execution signal RD_act to the back FIFO controller 133. The back FIFO controller 133 controls the back FIFO 120 in response to the read execution signal RD_act so that the input back FIFO input data B_in can be stored in the first back memory 121.

In a period t_a2, the front FIFO controller 132 of the controller 130 controls the front FIFO 110 in response to the input valid signal F_do input from the encoder 200 so that the input front FIFO input data F_in can be stored in the second front memory 112. The back FIFO controller 133 controls the back FIFO 120 in response to the output valid signal B_do output from the decoder 300 so that the data stored in the second back memory 122 can be output as the back FIFO output data B_out. The front back FIFO controller 132 outputs the write ready signal WR_do when a predetermined amount of data is stored in the second front memory 112, and the back FIFO controller 133 outputs the read ready signal RD_do to the main controller 131 after all data stored in the second back memory 122 are output.

That is, when the operations of the periods t_a1, t_a2, t_b1, and t_b2 are finished, frame data of the first line of the current frame and frame data of the first line of the previous frame are input to the acceleration value computer 500. Data corresponding to ½ of the first line is stored in the area 1A_2 of the external memory 20, and data corresponding to the remaining ½ is stored in the second front memory 112 of the front FIFO 110. Data corresponding to ½ of the second line of the previous frame is stored in the first back memory 121 of the back FIFO 120.

In a period t_a3, the front FIFO controller 132 controls the front FIFO 110 so that the first front memory 111 of the front FIFO 110 can receive and store the input front FIFO input data F_in and the second front memory 112 can output stored data as the front FIFO output data F_out. The back FIFO controller 133 controls the back FIFO 120 so that data stored in the first back memory 121 of the back FIFO 120 can be output as the back FIFO output data B_out.

In a period t_b3, the main controller 131 controls the data buffer 140 and the external memory 20 in response to the write ready signal WR_do output from the front FIFO controller 132 so that the external memory 20 can receive and store the front FIFO output data F_out output from the front FIFO 110. The main controller 131 may control the external memory 20 so that the front FIFO output data F_out can be stored in the area 1B_2 of the external memory 20 illustrated in FIG. 6.

In a period t_b4, the main controller 131 controls the external memory 20 to perform the read operation in response to the read ready signal RD_do output from the back FIFO controller 133. The main controller 131 may control the external memory 20 to read data stored in the area 2B_1 of the external memory 20 illustrated in FIG. 6. The back FIFO controller 133 controls the back FIFO 120 in response to the read execution signal RD_act output from the main controller 131 so that data output from the external memory 20 can be stored in the second back memory 122.

When the operations of the periods t_a3, t_b3, and t_b4 are finished, ½ of data of the second line of the current frame is stored in the first front memory 111 of the front FIFO 110, and the remaining ½ of the data of the first line of the current frame is stored in the external memory 20. ½ of data of the second line of the previous frame is output to the decoder 300 from the first back memory 121 of the back FIFO 120, and the data is decoded by the decoder 300 to be input to the acceleration value computer 500. The remaining ½ of the data of the second line of the previous line is stored in the second back memory 122 of the back FIFO 120.

Operations of periods t_a4, t_b5, and t_b6 can be easily understood with reference to the operations of the periods t_a2, t_b1, and t_b2.

That is, the memory controller 100 of the display controller according to some embodiments includes the front FIFO 110 which temporarily stores input data and the back FIFO 120 which temporarily stores output data and thus can write/read data to/from the external memory 20 in the burst mode. Therefore, the response time accelerator may be configured using the external memory 20 which operates at a low speed. Actually, when the memory controller 100 of the response time accelerator according to some embodiments is employed in a system of 1920*1080 full high definition (HD) with a frame rate of 120 Hz and a 10-bit RGB, an SDRAM which operates at 160 MHz can be used as the external memory 20. In this case, when a CAS latency is set to 2 clocks and a delay clock necessary when starting the write operation is set to 1 clock, as illustrated in FIG. 9, a time t_b3 to t_b6 for writing/reading data corresponding to one line in/from the external memory 200 may be slightly longer than a time t_a3 and t_a4 in which data of one line is actually transmitted, but since a porch period is commonly present between respective lines, an operational problem does not occur.

As described above, the display controller according to some embodiments includes a memory controller which effectively writes/reads compressed frame data to/from an external memory and thus can operate a response time accelerator using an external memory which operates at a low speed.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed is:

1. A display controller, comprising:

an external memory;

a timing controller configured to compress current frame data to generate front first in-first out (FIFO) input data, temporarily store the front FIFO input data and write the front FIFO input data to the external memory in a burst mode, and configured to read data from the external memory in the burst mode, temporarily store the read data as back FIFO output data, and decode the back FIFO output data to output previous frame data; and a memory controller configured to temporarily store the front FIFO input data and write the front FIFO input data to the external memory in the burst mode in response to an input valid signal, and configured to read the data from the external memory in the burst mode, temporarily store the read data as the back FIFO output data and output the back FIFO output data in response to an output valid signal, wherein the memory controller comprises:

a controller configured to output a front control signal, a back control signal, a memory control signal, and a data buffer control signal, in response to the input valid signal and the output valid signal;

a front FIFO confimed to temporarily store the front FIFO input data and output the stored front FIFO input data as the front FIFO output data, in response to the front control signal;

a back FIFO configured to temporarily store the back FIFO input data and output the stored back FIFO input data as the back FIFO output data in response to the back control signal; and a data buffer configured to output the front FIFO output data to the external memory or output data output from the external memory as the back FIFO input data, in response to the data buffer control signal, wherein the external memory is configured to write data input from the data buffer in the burst mode or read stored data in the burst mode to output the data to the data buffer, in response to the memory control signal.

2. The display controller of claim 1, wherein the timing controller comprises:

an encoder configured to compress the current frame data to generate the front FIFO input data and output the front FIFO input data and the input valid signal representing a period in which the front FIFO input data is valid; and a decoder configured to output the output valid signal when decoding is ready, and receive and decode the back FIFO output data to generate the previous frame data, and wherein the display controller further comprises an acceleration value computer configured to receive the current frame data and the previous frame data and compare the current frame data with the previous frame data to output an acceleration value.

3. The display controller of claim 2, wherein the front FIFO comprises:

first and second front memories configured to store and output data in response to the front control signal;

a front input switch configured to output the front FIFO input data to the first front memory or the second front memory, in response to the front control signal; and a front output switch configured to output data output from the first front memory or the second front memory as the front FIFO output data, in response to the front control signal.

4. The display controller of claim 3, wherein the back FIFO comprises:

first and second back memories configured to store and output data in response to the back control signal;

a back input switch configured to output the back FIFO input data to the first back memory or the second back memory, in response to the back control signal; and a back output switch configured to output data output from the first back memory or the second back memory as the back FIFO output data, in response to the back control signal.

5. The display controller of claim 4, wherein the first and second front memories and the first and second back memories are dual port memories.

6. The display controller of claim 4, wherein when frame data of a first frame is input, wherein the controller is further configured to:

during a first input period, output the front control signal in response to the input valid signal so that the front FIFO input data is stored in the first front memory;

during a second input period, output the front control signal so that data stored in the first front memory is output as the front FIFO output data and the front FIFO input data is stored in the second front memory in response to the input valid signal, and output the memory control signal and the data buffer control signal so that the front FIFO output data is written to the external memory in the burst mode, during a third input period, output the front control signal so that data stored in the second front memory is output as the front FIFO output data and the front FIFO input data is stored in the first front memory in response to the input valid signal, and output the memory control signal and the data buffer control signal so that the front FIFO output data is written to the external memory in the burst mode;

repeat the operations of the second input period and the third input period until all data of the first frame are stored, and when all data of the first frame are stored;

output the memory control signal, the data buffer control signal, and the back control signal to read data of a first line among data of the first frame from the external memory in the burst mode; and temporarily store the data of the first line in the first back memory and the second back memory.

7. The display controller of claim 4, wherein when data of a second or subsequent frame is input, and wherein the controller is configured to:

in a first input/output period, output the front control signal so that the front FIFO input data is stored in the first front memory and output the back control signal so that data stored in the first back memory is output as the back FIFO output data;

in a second input/output period, output the front control signal so that the front FIFO input data is stored in the second front memory and data stored in the first front memory is output as the front FIFO output data, output the memory control signal and the data buffer control signal so that the front FIFO output data is written to the external memory in the burst mode and frame data corresponding to ½ of a second line among data of a previous frame stored in the external memory is read in the burst mode and output as the back FIFO input data, and outputs the back control signal so that data stored in the second back memory is output as the back FIFO output data and the back FIFO input data is stored in the first back memory;

in a third input/output period, output the front control signal so that the front FIFO input data is stored in the first front memory and data stored in the second front memory is output as the front FIFO output data, output the memory control signal and the data buffer control signal so that the front FIFO output data is written to the external memory in the burst mode and frame data corresponding to the remaining ½ of the second line among the data of the previous frame stored in the external memory is read in the burst mode to be output as the back FIFO input data, and output the back control signal so that data stored in the first back memory is output as the back FIFO output data and the back FIFO input data is stored in the second back memory; and repetitively perform the operations of the second input/output period and the third input/output period for data of each remaining line among frame data.

8. The display controller of claim 7, wherein the controller comprises:

a front FIFO controller configured to output the front control signal in response to the input valid signal and a write execution signal, output a write ready signal when a predetermined amount of data is written to the first front memory or the second front memory, and output a first frame end signal when all data of the first frame are input/output in/from the front FIFO;

a back FIFO controller configured to output the back control signal in response to the first frame end signal, the output valid signal, and a read execution signal and output a read ready signal when all data stored in the first back memory or the second back memory are output; and a main controller configured to output the memory control signal, the data buffer control signal and the write execution signal in response to the write ready signal so that the front FIFO output data is written to the external memory in the burst mode, and output the memory control signal, the data buffer control signal and the read execution signal in response to the read ready signal so that data stored in the external memory is read in the burst mode and output to the back FIFO.

9. The display controller of claim 8, wherein the external memory includes $n^{th}$ to $(n+3)^{th}$ banks, and wherein the controller is configured to output the memory control signal so that data output from the first front memory is sequentially stored in the $n^{th}$ bank and $(n+2)^{th}$ bank and data output from the second front memory is sequentially stored in the (n+1) bank and $(n+3)^{th}$ bank.

* * * * *